US006792988B2

(12) United States Patent
Miller

(10) Patent No.: US 6,792,988 B2
(45) Date of Patent: Sep. 21, 2004

(54) LABELING DEVICE

(75) Inventor: Howard Ira Miller, Berkley, CA (US)

(73) Assignee: Memorex Products, Inc., Santa Fe Springs, CA (US)

( * ) Notice: Subject to any disclaimer, the term of this patent is extended or adjusted under 35 U.S.C. 154(b) by 0 days.

(21) Appl. No.: 10/329,652

(22) Filed: Dec. 26, 2002

(65) Prior Publication Data

US 2003/0168179 A1 Sep. 11, 2003

Related U.S. Application Data

(60) Provisional application No. 60/368,181, filed on Mar. 28, 2002, provisional application No. 60/351,249, filed on Jan. 24, 2002, and provisional application No. 60/344,071, filed on Dec. 28, 2001.

(51) Int. Cl.[7] ..... B65C 1/00; B65C 1/02; B65C 9/26

(52) U.S. Cl. ..... 156/391; 156/538; 156/556; 156/DIG. 1; 156/DIG. 2

(58) Field of Search ..... 156/391, 538, 156/556, 580, DIG. 1, DIG. 2, DIG. 24, DIG. 37, DIG. 42

(56) References Cited

U.S. PATENT DOCUMENTS

| | | | | | |
|---|---|---|---|---|---|
| 5,951,819 | A | * | 9/1999 | Hummell et al. | 156/556 |
| 6,302,176 | B1 | * | 10/2001 | Chen | 156/391 |
| 6,315,021 | B1 | * | 11/2001 | Lee et al. | 156/391 |
| 6,321,811 | B1 | * | 11/2001 | Atkinson et al. | 156/391 |
| 6,408,918 | B1 | * | 6/2002 | Hummell et al. | 156/391 |
| 6,435,243 | B2 | * | 8/2002 | Koch | 156/391 |
| 2001/0042600 | A1 | * | 11/2001 | Liao | 156/582 |
| 2002/0162631 | A1 | * | 11/2002 | Wien et al. | 156/391 |
| 2003/0131942 | A1 | * | 7/2003 | Chieh | 156/391 |

FOREIGN PATENT DOCUMENTS

EP 1 029 792 A1 8/2000

OTHER PUBLICATIONS

International Search Report dated Sep. 26, 2003 from PCT/IB02/05805.

* cited by examiner

*Primary Examiner*—Sue A. Purvis
(74) *Attorney, Agent, or Firm*—Ohlandt, Greeley, Ruggiero & Perle, L.L.P.

(57) ABSTRACT

A labeling device is provided. The labeling device can accommodate labels and media having differing geometries.

25 Claims, 10 Drawing Sheets

LABELING DEVICE

RELATED APPLICATION

This application is related to and claims priority in, copending U.S. Provisional Application Ser. No. 60/344,071, filed Dec. 28, 2001, copending U.S. Provisional Application Ser. No. 60/351,249, filed Jan. 24, 2002 and copending U.S. Provisional Application Ser. No. 60/368,181, filed Mar. 28, 2002, the disclosures of which are incorporated herein by reference.

SUMMARY OF THE INVENTION

1. Field of the Invention

The present invention relates to labeling devices. More particularly, the present invention relates to labeling devices that accommodate different shapes and sizes of media.

2. Description of the Related Art

Labeling devices for applying labels to compact discs are known. Such devices apply a label to a compact disc by moving the label and disc toward each other until they make contact. These devices suffer from the drawback of only being usable on one size CD.

SUMMARY OF THE INVENTION

It is an object of the present invention to provide a labeling device that can accommodate media of different sizes or shapes.

It is a further object of the present invention to provide such a labeling device that can concentrically locate and align media of different sizes or shapes.

These and other objects and advantages of the present invention are provided by a labeling device for applying a first label to a first medium having first geometries, and for applying a second label to a second medium having second geometries. The device has a housing having a first labeling portion and a second labeling portion. The first labeling portion applies the first label to the first medium and the second labeling portion applies the second label to the second medium.

The present invention also includes a labeling device having a first labeling portion with first and second surfaces and a second labeling portion with third and fourth surfaces. The first labeling portion is connected to the second labeling portion. The first and second surfaces are movable relative to each other from a first position in which the first and second surfaces are remote from each other to a second position in which the first and second surfaces are in proximity to each other. The third and fourth surfaces are movable relative to each other from a third position in which the third and fourth surfaces are remote from each other to a fourth position in which the third and fourth surfaces are in proximity to each other. One of the first or second surfaces holds the first label and the other of the first or second surfaces holds the first medium, and one of the third or fourth surfaces holds the second label and the other of the third or fourth surfaces holds the second medium.

The first labeling portion can have a first piston and a first housing with the first surface being disposed on the first piston and the second surface being disposed on the first housing. The second labeling portion can have a second piston and a second housing with the third surface being disposed on the second piston and the fourth surface being disposed on the second housing. The first housing can have a first opening formed therein and the first piston can travel partially through the first opening. The second housing can have a second opening formed therein and the second piston can travel partially through the second opening. The device can further have a resilient member that biases the first and second pistons such that the first and second surfaces are in the first position and the third and fourth surfaces are in the third position. The first housing can have at least one holding tab for locating the first label or the first medium on the second surface. The second housing can have a wall on at least a portion of the fourth surface for locating the second label or the second medium on the fourth surface. The wall can have a circular portion and a planar portion with the circular portion for locating the second label or medium having a circular shape and the planar portion for locating the second label or medium having a rectangular shape. The first housing can further have a stem and the first piston can further have a center opening with the stem disposed through the center opening so that the first piston can move along the stem. The first piston can have a first cylindrical member and a second cylindrical member having an inner hollow portion. The second piston can further have a third cylindrical member, a fourth cylindrical member and a fifth cylindrical member. The fifth cylindrical member can be at least partially disposed in the inner hollow portion of the second cylindrical member. The first and second cylindrical members can be concentrically aligned to form a first shoulder with the first surface being disposed on the first shoulder. The third and fourth cylindrical members can be concentrically aligned to form a second shoulder with the third surface being disposed on the second shoulder. The resilient member can be disposed in the inner hollow portion of the second cylindrical member.

The present invention further includes a labeling device having a housing with an upper surface and an opening formed through the upper surface; an outer piston having a top surface and an orifice formed through the top surface; an inner piston having a shoulder with the inner piston being disposed at least partially in the orifice of the outer piston; and a locking mechanism. The outer piston slides through the opening in the upper surface from a first position in which the top surface is remote from the upper surface to a second position in which the top surface is in proximity to the upper surface. The inner piston slides through the orifice in the outer piston from a third position in which the shoulder is remote from the upper surface to a fourth position in which the shoulder is in proximity to the upper surface. The locking mechanism selectively retains the outer piston in the second position. The upper surface locates the labels and the shoulder locates the media. The housing can further have a stem and the inner piston can further have a hollow inner volume. The stem can be disposed at least partially in the hollow inner volume so that the inner piston can move along the stem. The inner piston can further have a first cylindrical member and a second cylindrical member. The first and second cylindrical members can be concentrically aligned to form the shoulder and the second cylindrical member can be at least partially disposed in the orifice in the outer piston. The device can further have a first resilient member and a second resilient member. The first resilient member can bias the outer piston in the first position and the second resilient member can bias the inner piston in the third position. The first resilient member can be a torsion spring and the second resilient member can be a coil spring.

BRIEF DESCRIPTION OF THE DRAWINGS

Attached are drawings of preferred embodiments of the labeling device of the present invention.

DESCRIPTION OF THE INVENTION

Figure 1:
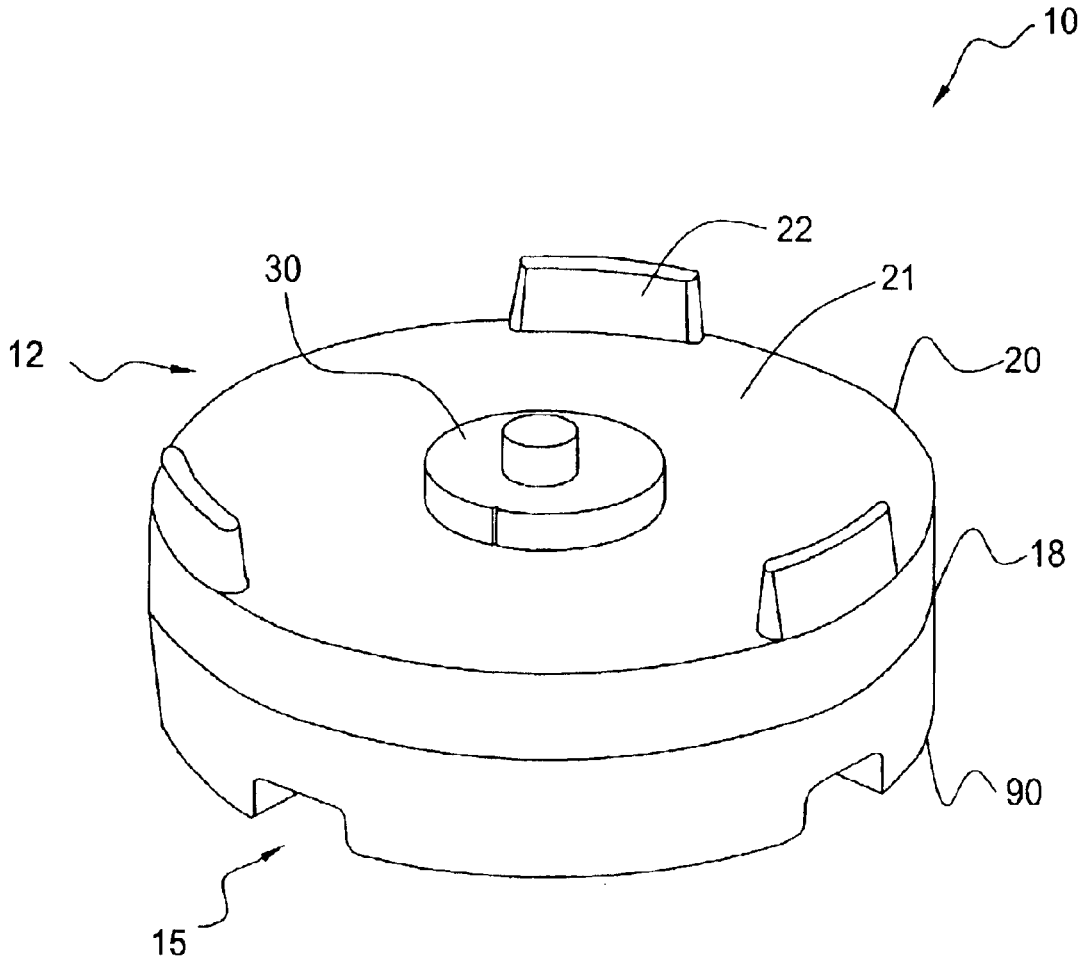
FIG. 1 shows a top perspective view of a first embodiment of the labeling device of the present invention.

Referring to the drawings and, in particular, FIG. 1, there is shown a preferred embodiment of a labeling device of the present invention generally represented by reference numeral 10. Labeling device 10 has a first labeling portion 12 and a second labeling portion 15.

Figure 2:
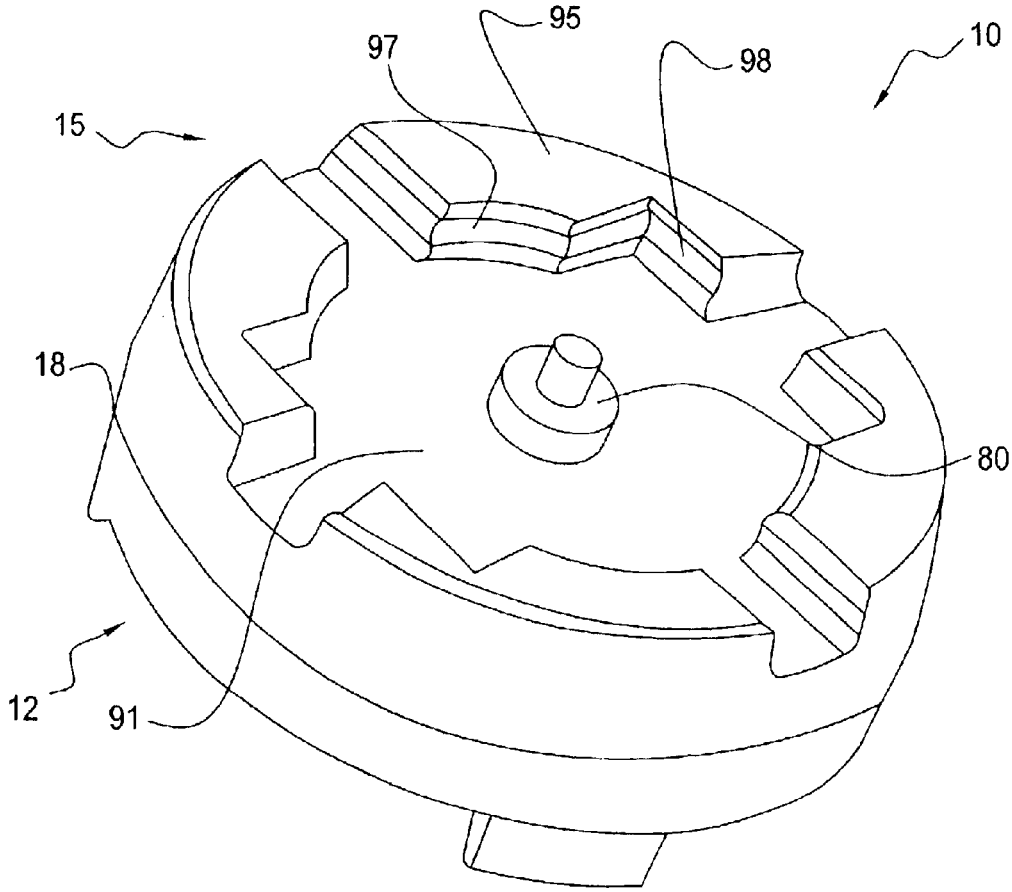
FIG. 2 shows a bottom perspective view of the device of FIG. 1.
Figure 3:
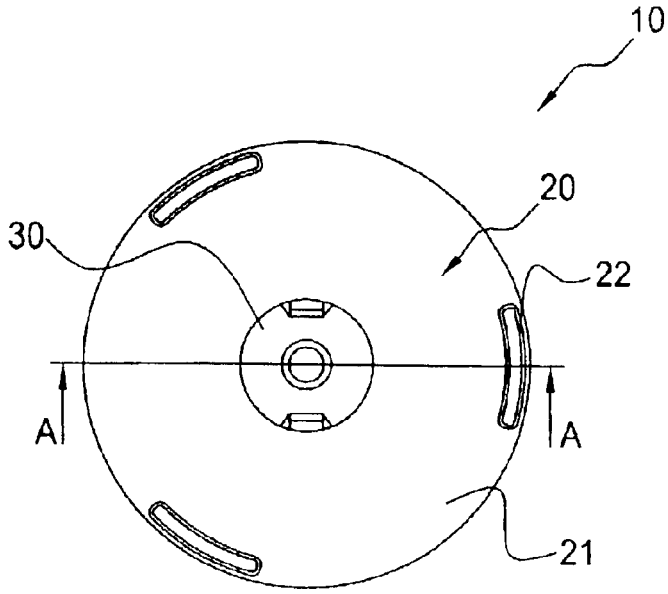
FIG. 3 shows a top view of the device of FIG. 1.
Figure 4:
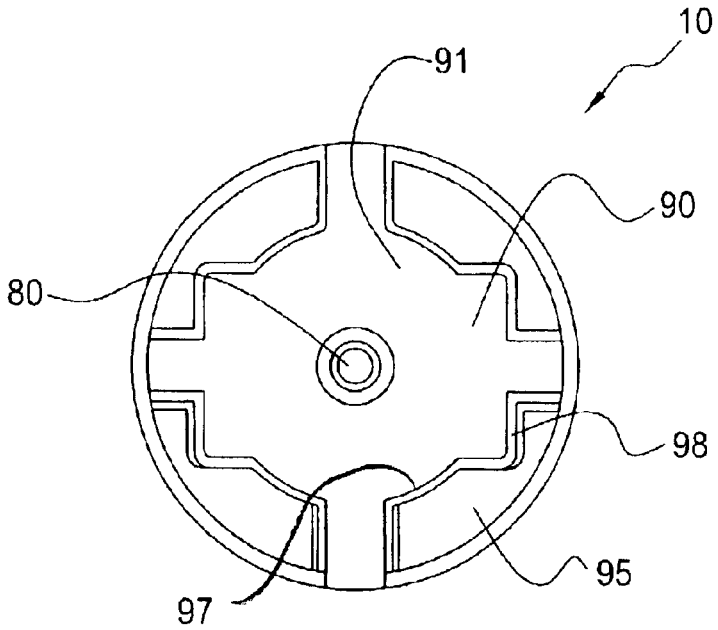
FIG. 4 shows a bottom view of the device of FIG. 1.

Referring to FIGS. 1 and 2, first labeling portion 12 has a top 20 and a movable upper boss or piston 30. Second labeling portion 15 has a movable lower boss or piston 80 and a bottom 90. Top 20 and bottom 90 are connected to each other to form a housing 18. For purposes of describing the present invention, labeling device 10 will be described with top 20 being above bottom 90. However, one of ordinary skill in the art would recognize that labeling device 10 can be rotated in different orientations.

Referring to FIGS. 1 through 8, first labeling portion 12 has an upper spring 40 and an upper body 50. Second labeling portion 15 also has a lower body 60 and a lower spring 70. Preferably, these elements are held together by a tolerance fit and substantially retained in housing 18.

Top 20 is a substantially flat, circular disc. Top 20 has a top surface 21 with a number of holding tabs 22 located thereon. Preferably, there are three holding tabs 22. Tabs 22 preferably are positioned along the periphery of top 20 and extend substantially perpendicular to top surface 21. Preferably, tabs 22 have a curved shape with a radius of curvature equal to the radius of top 20. Tabs 22 are preferably equi-distantly spaced apart along the periphery of top 20. Tabs 22 are spaced apart to locate and hold a self-adhesive compact disc label on top surface 21 for adhering the label to a compact disc. Preferably, the self-adhesive compact disc label is for a 120 mm CD.

Top 20 has a top opening 23 formed therein. Top opening 23 has a circular shape and is centrally disposed along top surface 21. Top opening 23 has a diameter larger than the diameter of upper boss 30 so that the upper boss can slide partially therethrough.

Upper boss 30 has a cylindrical shape with a center hole 33, a retaining ring 35 and an upper surface 37. Center hole 33 has a circular shape and is centrally formed in upper boss 30. Retaining ring 35 is disposed along the lower portion of upper boss 30 and has a diameter larger than the diameter of top opening 23 in order to prevent the upper boss from completely passing through the top opening. Alternatively, retaining ring 35 can be a projection or plurality of projections disposed along the outer side of upper boss 30 to prevent the upper boss from completely passing through top opening 23.

Figure 7:
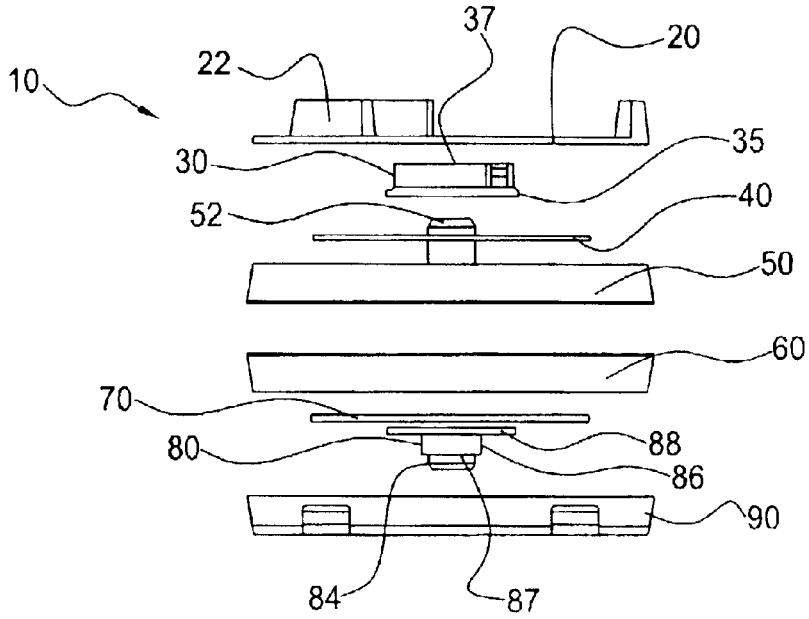
FIG. 7 shows an exploded front view of the device of FIG. 1.
Figure 8:
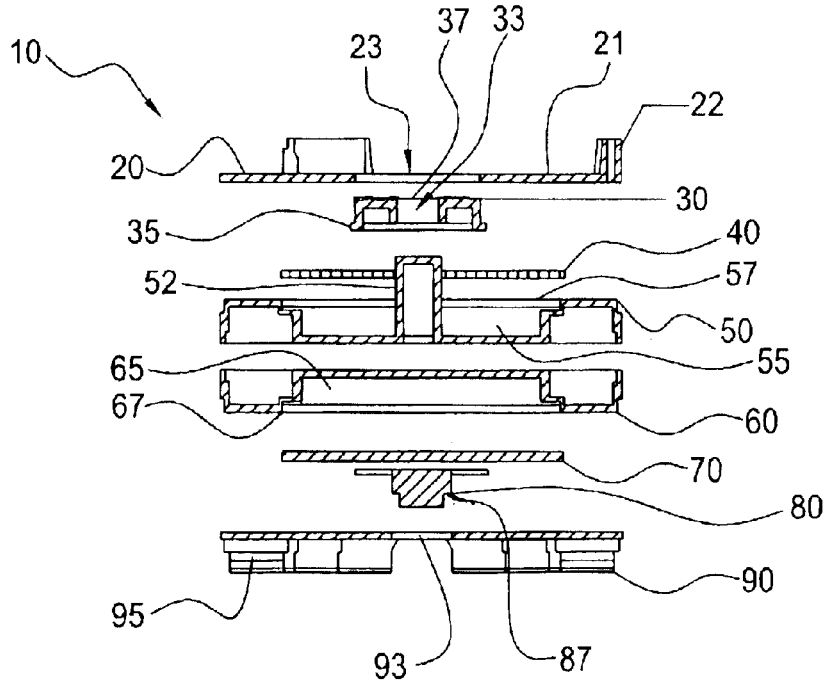
FIG. 8 shows an exploded cross-sectional view of the device of FIG. 1 taken along line A—A of FIG. 3.

Referring to FIGS. 7 and 8, upper body 50 has a cylindrical shape with a stem 52 and an upper recess 55. Stem 52 has a cylindrical shape. Stem 52 is centrally disposed on upper body 50 and extends from upper recess 55 through top opening 23 such that the stem extends above top surface 21. Preferably, stem 52 is perpendicular to upper body 50 and top surface 21. Stem 52 has a diameter that is smaller than the diameter of center hole 33 in upper boss 30 so that the upper boss can slide along the stem.

Upper recess 55 of upper body 50 has a circular shape with an upper groove or indent 57 formed along the circumference of the upper recess. Upper recess 55 has a height and diameter larger than the height and diameter of upper boss 30 so that the upper boss can slide down stem 52 and into upper recess 55 with upper surface 37 of the upper boss being in proximity to or below top surface 21 of top 20. Preferably, upper boss 30 can slide down stem 52 and into upper recess 55 with upper surface 37 of the upper boss being flush with top surface 21 of top 20. Upper groove 57 of upper recess 55 has a height and diameter larger than the height and diameter of upper spring 40 so that the upper spring can sit in the upper groove.

Figure 5:
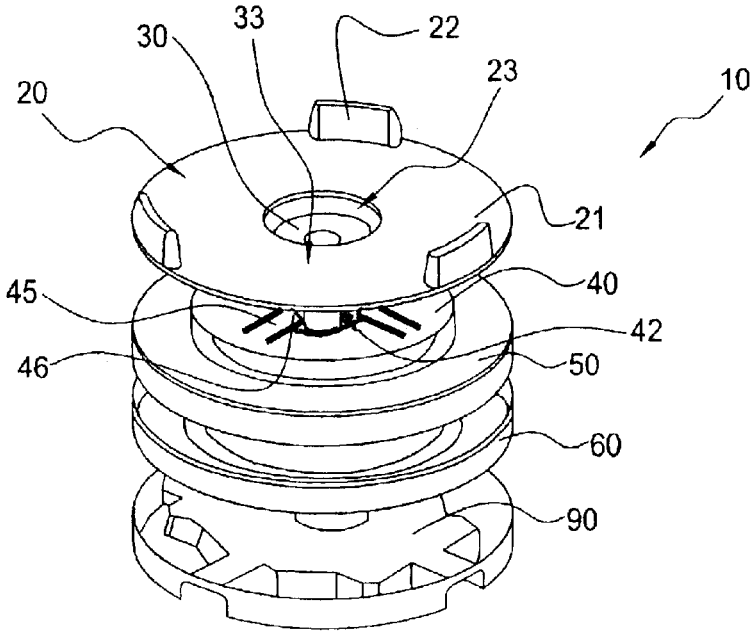
FIG. 5 shows an exploded top perspective view of the device of FIG. 1.
Figure 6:
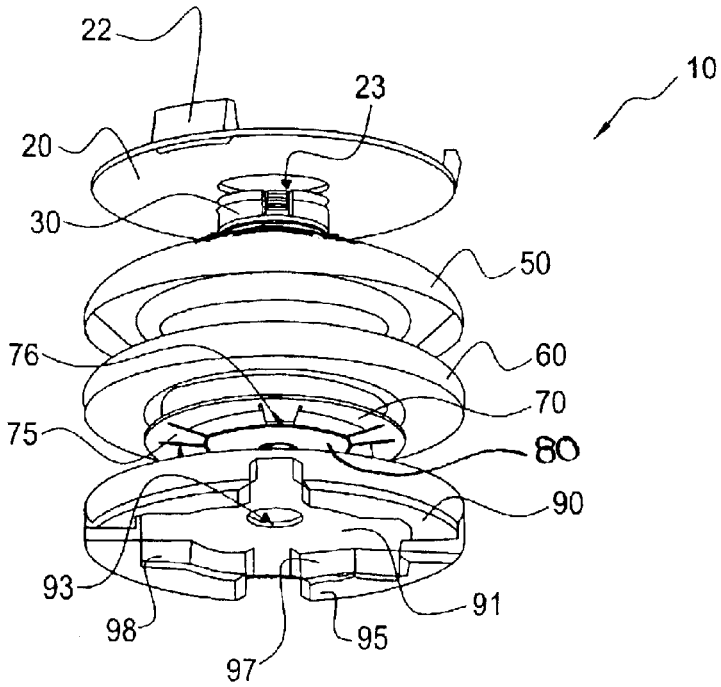
FIG. 6 shows an exploded bottom perspective view of the device of FIG. 1.

Referring to FIGS. 5 and 6, upper spring 40 has a disc-like shape with an upper orifice 42 and a number of resilient members or projections 45. Upper orifice 42 has a diameter larger than the diameter of stem 52 so that upper spring 40 can be positioned around the stem and can be seated in upper groove 57 of upper body 50, when labeling device 10 is assembled.

In this embodiment, four resilient projections 45 are used, but alternative numbers of resilient projections can also be used. Resilient projections 45 are flat springs having first ends 46 that extend partially into upper orifice 42. Resilient projections 45 make contact with upper boss 30 to bias the upper boss in a raised position with upper surface 37 of the upper boss disposed above top surface 21 of top 20. When a force is applied to upper boss 30, the upper boss slides down along stem 52 and into upper recess 55 against the bias of resilient projections 45. In this embodiment, upper spring 40 uses resilient projections 45 to provide a bias against movement of upper boss 30. Alternative resilient members can also be used to provide a bias to upper boss 30, such as, for example, a coil spring.

Bottom 90 is a circular disc having a bottom surface 91, a bottom opening 93 and a peripheral wall 95. Bottom opening 93 has a circular shape and is centrally disposed along bottom surface 91.

Peripheral wall 95 is preferably separated into four portions. Each portion of peripheral wall 95 has a circular wall section 97 and a rectangular wall section 98. In this embodiment, there are four peripheral wall portions 95 and, thus, four circular wall sections 97 and four rectangular wall sections 98. Circular wall sections 97 are spaced apart to locate and hold a self-adhesive compact disc label on bottom surface 91 for applying the label to a compact disc.

Preferably, the self-adhesive compact disc label is for an 80 mm size CD. Rectangular wall sections 98 are spaced apart to locate and hold a self-adhesive label on bottom surface 91 for applying the label to an Electronic Business Card.

Referring to FIG. 7, lower boss 80 has a telescoping cylindrical shape with a first rod or member 84, a second rod or member 86 and a retaining member 88. First rod 84 and second rod 86 are concentrically aligned. First rod 84 has a diameter smaller than the diameter of second rod 86 so that a bottom shoulder 87 is formed. Second rod 86 has a diameter that is smaller than the diameter of bottom opening 93 so that lower boss 80 can partially slide therethrough.

Retaining member 88 is disposed along the upper portion of lower boss 80 and has a diameter larger than the diameter of bottom opening 93 in order to prevent the lower boss from completely passing through the bottom opening. Alternatively, retaining member 88 can be a projection or plurality of projections disposed along second rod 86 of lower boss 80 to prevent the lower boss from completely passing through bottom opening 93.

Referring to FIG. 7, lower body 60 has a cylindrical shape with a lower recess 65 formed centrally therein. Lower recess 65 has a circular shape with a lower groove or indent 67 formed along the circumference of the lower recess. Lower recess 65 has a height and diameter larger than the height and diameter of lower boss 80 so that the lower boss can slide through bottom opening 93 and into lower recess 65 with bottom shoulder 87 of the lower boss being in proximity to or below bottom surface 91, shown in FIG. 6, of bottom 90. Preferably, lower boss 80 can slide through bottom opening 93 and into lower recess 65 with bottom shoulder 87 of the lower boss being flush with bottom surface 91 of bottom 90. Lower groove 67 of lower recess 65 has a diameter larger than the diameter of lower spring 70 so that the lower spring can sit in the lower groove.

Referring to FIGS. 6 and 8, lower spring 70 has a disc-like shape with a lower orifice 72 and a number of resilient members or projections 75. In this embodiment, four resilient projections 75 are used, but alternative numbers of resilient projections can also be used. Resilient projections 75 are flat springs having first ends 76 that extend partially into lower orifice 72. Resilient projections 75 make contact with lower boss 80 to bias the lower boss in an extended position with bottom shoulder 87 of the lower boss disposed below bottom surface 91 of bottom 90. When a force is applied to lower boss 80, the lower boss slides through bottom opening 93 and into lower recess 65 against the bias of resilient projections 75. In this embodiment, lower spring 70 uses resilient projections 75 to provide a bias against movement of lower boss 80. Alternative resilient members can also be used to provide a bias to lower boss 80, such as, for example, a coil spring.

In the preferred embodiment, the positioning and communication between upper boss 30 and upper spring 40, and lower spring 70 and lower boss 80, allow a 120 mm CD label, an 80 mm CD label or an Electronic Business Card label to be accurately located on a 120 mm CD, 80 mm CD or Electronic Business Card, respectively. The present invention uses first labeling portion 12 to apply a label to a 120 mm CD and uses second labeling portion 15 to apply a label to either an 80 mm CD or an Electronic Business Card. While the present invention allows for application of labels to a 120 mm CD, an 80 mm CD or an Electronic Business Card, alternative sizes and shapes of media can also be accommodated.

In operation, a user can apply labels to media of different geometry using a single device, i.e., labeling device 10. First labeling portion 12 can be used to apply a first label to a first medium having first geometries and second labeling portion 15 can be used to apply a second label to a second medium having second geometries. As described herein, the geometry of the labels and media refers to the shape and dimensions.

For first labeling portion 12, the user positions the first label on top surface 21 between holding tabs 22 and positions the first medium on upper boss 30. In the preferred embodiment, first labeling portion 12 applies labels to compact discs so the first label will be positioned on top surface 21 such that upper boss 30 passes through a central aperture of the label, and the first medium will be positioned on upper boss 30 such that stem 52 passes through a central aperture of the first medium and the first medium is flush with upper surface 37 of the upper boss. A user then applies a force upon upper boss 30, which causes the upper boss to move against the bias of upper spring 40 into upper recess 55 until upper surface 37 is in proximity to top surface 21. As a result, the first medium and the first label move relative to each other until they make contact and the first label is applied to the first medium. The use of movable upper boss 30 and holding tabs 22 ensure that the first label and the first medium are concentrically aligned.

For second labeling portion 15, the user positions the second label on bottom surface 91 between peripheral wall portions 95 and positions the second medium on bottom shoulder 87 of lower boss 80. In the preferred embodiment, second labeling portion 15 applies labels to compact discs or to Electronic Business Cards so the second label will be positioned on bottom surface 91 such that lower boss 80 passes through a central aperture of the label, and the second medium will be positioned on bottom shoulder 87 of lower boss 80 such that first rod 84 passes through a central aperture of the second medium and the second medium is flush with bottom shoulder 87 of the lower boss. A user then applies a force upon lower boss 80, which causes the lower boss to move against the bias of lower spring 70 into lower recess 65 until bottom shoulder 87 is in proximity to bottom surface 91. As a result, the second medium and the second label move relative to each other until they make contact and the second label is applied to the second medium. The use of movable lower boss 80 and peripheral wall portions 95 ensure that the second label and the second medium are concentrically aligned. Second labeling portion 15 can be used for both compact discs and Electronic Business Cards. Peripheral wall portions 95 have both circular wall sections 97 and rectangular wall sections 98 to locate and hold a self-adhesive compact disc label or self-adhesive Electronic Business Card label, respectively.

It should be recognized by one of skill in the art that while the preferred embodiment allows for application of labels to a 120 mm CD, an 80 mm CD or an Electronic Business Card, alternative sizes and shapes of media can also be accommodated by varying the sizes and shapes of top 20, upper boss 30, lower boss 80 and bottom 90. Also, the preferred embodiment uses movable upper and lower bosses or pistons 30, 80, which move with respect to top and bottom surfaces 21, 91 in order to concentrically align and apply the different labels to the different media. Alternative movable members can also be used so that first labeling portion 12 can apply a first label to a first medium having first geometries and second labeling portion 15 can apply a second label to a second medium having second geometries. Additionally, in the preferred embodiment, first labeling portion 12 and second labeling portion 15 use separate movable upper and lower bosses 30, 80 to concentrically align and apply the labels to the media. Alternatively, upper boss 30 and lower boss 80 can be integrally formed so as to move as a single unit.

Figure 9:
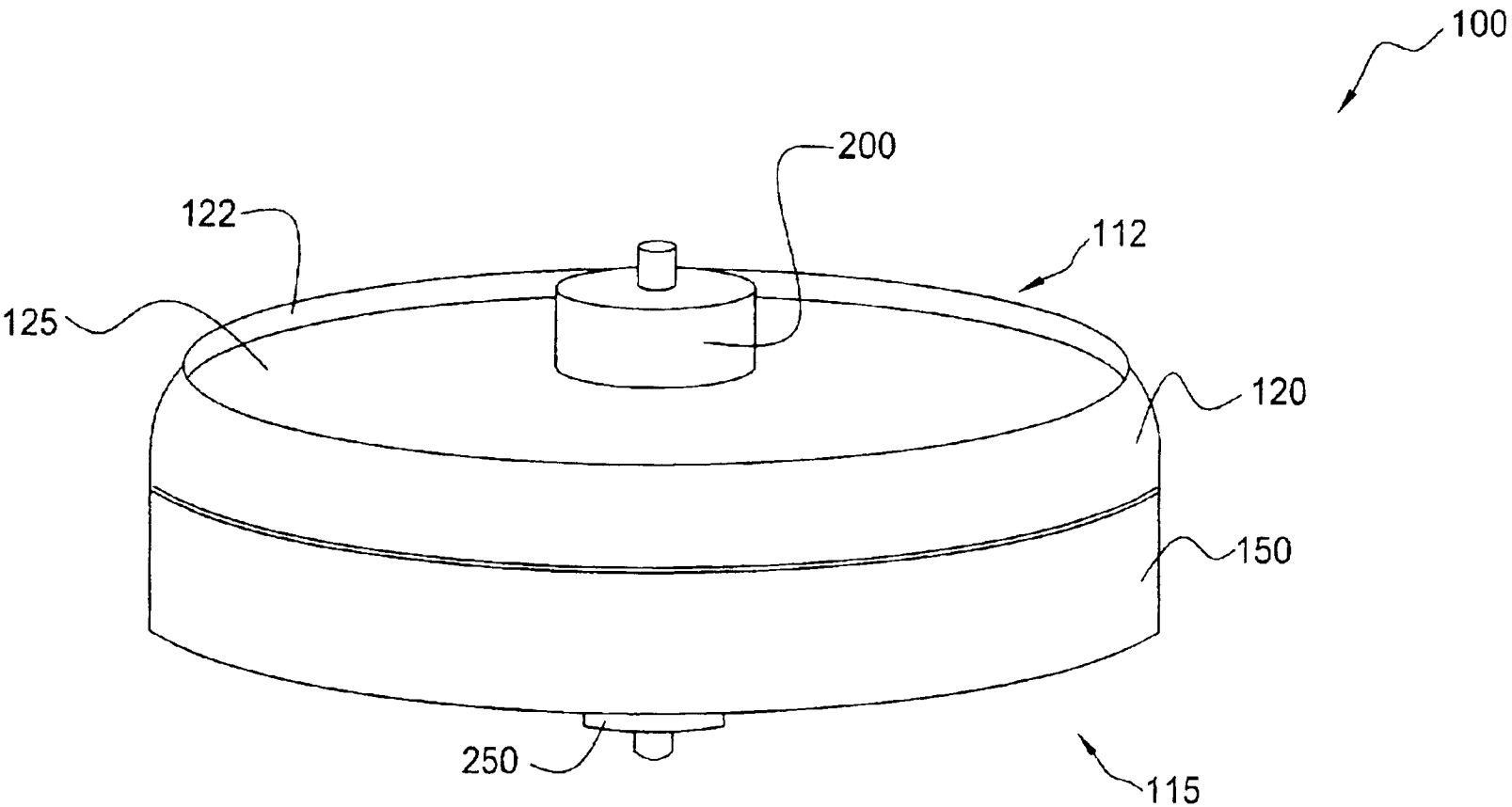
FIG. 9 shows a top perspective view of a second embodiment of the labeling device of the present invention.

Referring to FIG. 9, there is shown a second embodiment of a labeling device of the present invention generally represented by reference numeral 100. Labeling device 100 has a first labeling portion 112 and a second labeling portion 115.

Figure 10:
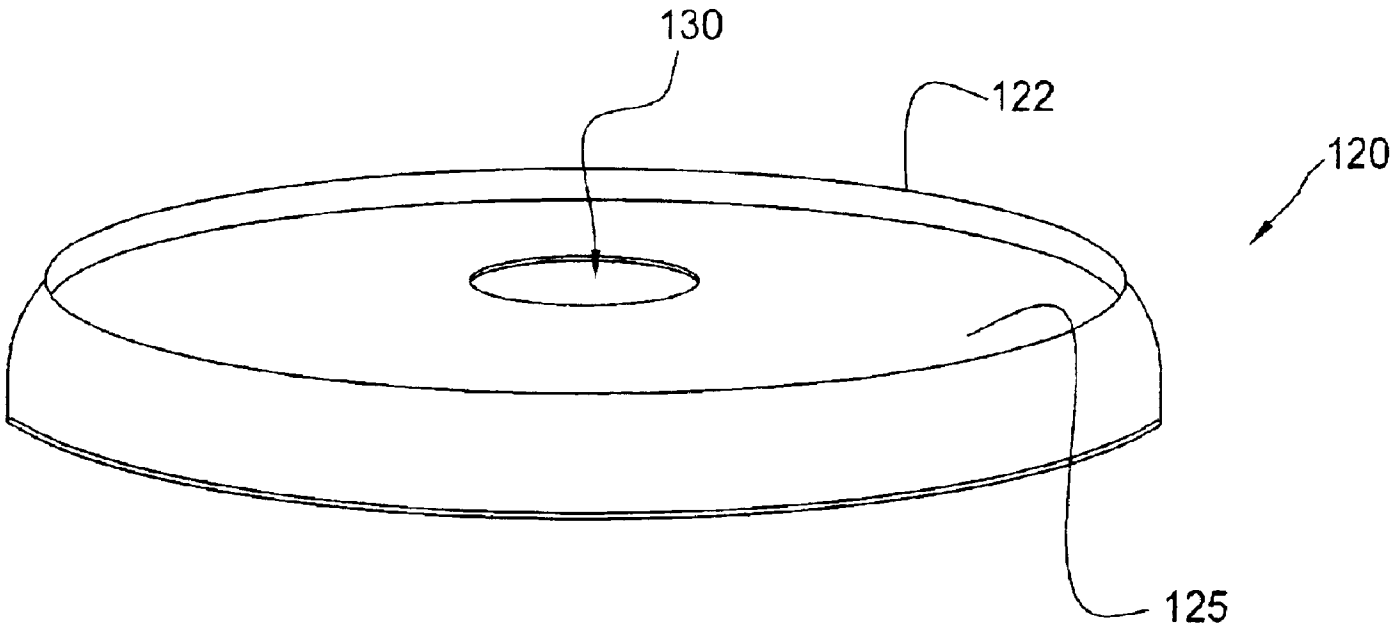
FIG. 10 shows a top perspective view of the top plate of the labeling device of FIG. 9.
Figure 11:
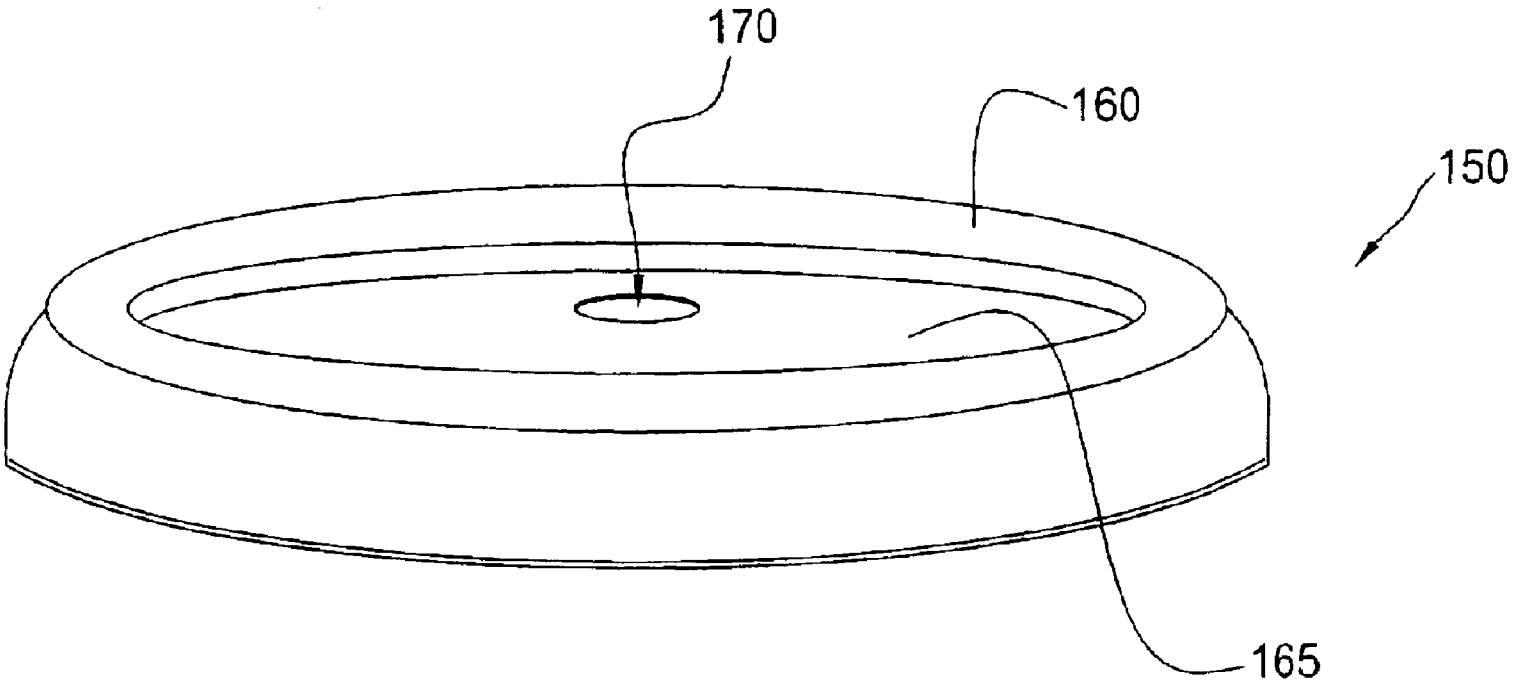
FIG. 11 shows a top perspective view of the bottom plate of the labeling device of FIG. 9.
Figure 12:
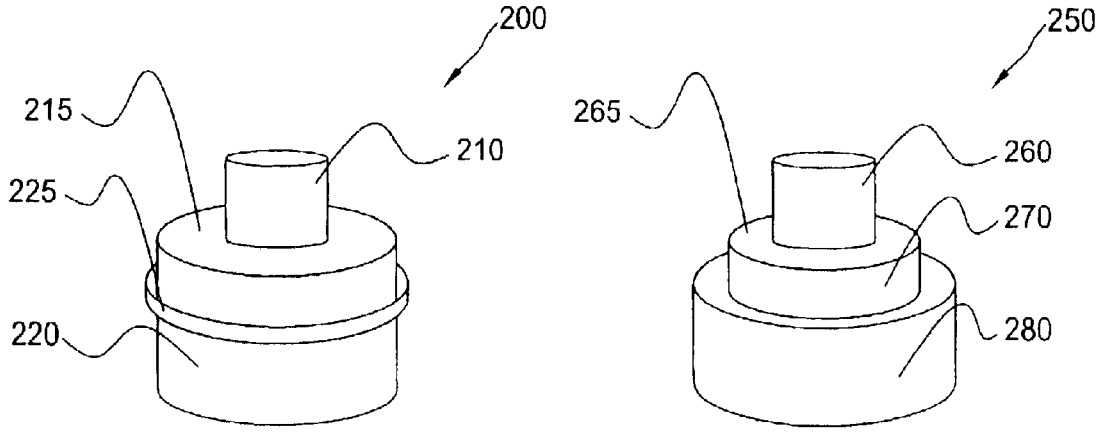
FIG. 12 shows a top perspective view of the top and bottom pistons of the labeling device of FIG. 9.
Figure 13:
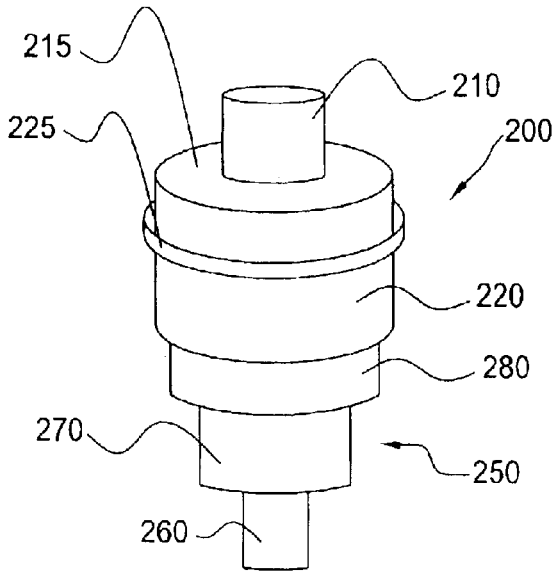
FIG. 13 shows a top perspective view of the assembled top and bottom pistons of FIG. 12.

Referring to FIGS. 9 through 11, first labeling portion 112 has a top plate 120 and a top piston 200. Second labeling portion 115 has a bottom plate 150 and a bottom piston 250. For purposes of describing the present invention, labeling device 100 will be described with top plate 120 being above bottom plate 150. However, one of ordinary skill in the art would recognize that labeling device 100 can be rotated in different orientations.

Referring to FIGS. 9 through 13, top plate 120 is cylindrical in shape and adapted to locate and hold a self-adhesive label. Preferably, in this embodiment, the self-adhesive label is for a 120 mm CD. Top plate 120 has a circular peripheral wall 122 and a top holding surface 125. Peripheral wall 122 provides for accurate positioning of the label. Preferably, peripheral wall 122 has a height between about 5 mm to about 20 mm and more preferably between about 10 mm to about 15 mm. Peripheral wall 122 surrounds holding surface 125. Preferably, holding surface 125 has a diameter between about 120 mm to about 130 mm and more preferably about 125 mm.

Holding surface 125 has a center hole 130 formed therethrough. Preferably, center hole 130 is centrally disposed in holding surface 125 and concentrically aligned with peripheral wall 122. Center hole 130 preferably has a diameter of about 41 mm to accommodate application of a label to a 120 mm CD.

Bottom plate 150 is cylindrical in shape and adapted to locate and hold a self-adhesive label. In this embodiment, the self-adhesive label is for an 80 mm CD. Bottom plate 150 has a circular peripheral wall 160 and a bottom holding surface 165. Peripheral wall 160 provides for accurate positioning of the label. Preferably, peripheral wall 160 has a height between about 5 mm to about 20 mm and more preferably between about 10 mm to about 15 mm. Peripheral wall 160 surrounds holding surface 165. Preferably, holding surface 165 has a diameter between about 80 mm to about 90 mm and more preferably about 85 mm.

Holding surface 165 has a center hole 170 formed therethrough. Preferably, center hole 170 is centrally disposed on holding surface 165 and concentrically aligned with peripheral wall 160. Center hole 170 preferably has a diameter about 20 mm to accommodate application of a label to an 80 mm CD.

Peripheral walls 122, 160 preferably have chamfered edges. Preferably, all surfaces of top plate 120 and bottom plate 150 are textured except holding surfaces 125, 165, which have smooth surfaces. Peripheral walls 122, 160 are preferably adapted for fastening top plate 120 to bottom plate 150. However, alternative ways can be used to secure top plate 120 to bottom plate 150.

Top piston 200 has a telescoping cylindrical shape with a first cylindrical member 210 adapted for engaging with a CD and a second cylindrical member 220 adapted for insertion through center hole 130 of top plate 120. First cylindrical member 210 is concentrically aligned with second cylindrical member 220. First cylindrical member 210 has a diameter smaller than the diameter of second cylindrical member 220 so that a top shoulder 215 is formed. Preferably, first cylindrical member 210 has a diameter of about 14 mm. Preferably, second cylindrical member 220 has a diameter of about 41 mm.

Top piston 200 also has a retaining member or ring 225. Retaining ring 225 has a diameter large enough to prevent the retaining ring from passing through center hole 130 of top plate 120. Preferably, retaining ring 225 has a diameter of about 42.5 mm. Alternative retaining structures can also be used for retaining ring 225, such as, for example, one or more projections formed on the outer surface of second cylindrical member 220. Second cylindrical member 220 is substantially hollow. Preferably, second cylindrical member 220 has an inner diameter of about 39.5 mm.

Bottom piston 250 has a telescoping cylindrical shape with a first cylindrical member 260 adapted for engaging with a CD, a second cylindrical member 270 adapted for insertion through center hole 170 of bottom plate 150, and a third cylindrical member 280 adapted for engagement with second cylindrical member 220 of top piston 200. First cylindrical member 260, second cylindrical member 270 and third cylindrical member 280 are concentrically aligned. First cylindrical member 260 has a diameter smaller than the diameter of second cylindrical member 270 so that a bottom shoulder 265 is formed. Preferably, first cylindrical member 260 has a diameter of about 14 mm. Preferably, second cylindrical member 270 has a diameter of about 20 mm. Preferably, third cylindrical member 280 has a diameter of about 39.5 mm. Third cylindrical member 280 has a diameter large enough to prevent the third cylindrical member from passing through center hole 170 of bottom plate 150 but small enough to engage with second cylindrical member 220 of top piston 200.

The present invention is assembled with top piston 200 and bottom piston 250 facing in opposite directions so that third cylindrical member 280 of bottom piston 250 is slidably engaged in the hollow inner portion of second cylindrical member 220 of top piston 200. A resilient member or structure (not shown) is operatively engaged between top piston 200 and bottom piston 250. In this embodiment, the resilient member is a resilient material, such as, for example, foam rubber, which is disposed in the hollow volume of second cylindrical member 220 of top piston 200. However, alternative resilient members can also be used, such as, for example, a coil spring. The concentric alignment and fit of third cylindrical member 280 of bottom piston 250 into second cylindrical member 220 of top piston 200 provides a self-guiding mechanism for the movement of the top and bottom pistons and further provides for a biased engagement with the resilient member disposed in the hollow inner portion of second cylindrical member 220.

Top and bottom pistons 200, 250 are positioned between top and bottom plates 120, 150. Top and bottom plates 120, 150 are then connected or secured to each other. Top piston 200 is partially slidable through center hole 130 of top plate 120 until retaining ring 225 contacts the center hole or undersurface of the top plate. Bottom piston 250 is partially slidable through center hole 170 until third cylindrical member 280 contacts the center hole or undersurface of bottom plate 150.

In this embodiment, the positioning and communication between top piston 200 and bottom piston 250, allow a 120 mm CD label and an 80 mm CD label to be accurately located on a 120 mm CD and an 80 mm CD, respectively. The present invention uses first labeling portion 112 to apply a label to a 120 mm CD and uses second labeling member 115 to apply a label to an 80 mm CD. While the present invention allows for application of labels to a 120 mm CD and an 80 mm CD, alternative sizes and shapes of media can also be accommodated.

In operation, a user can apply labels to media of different geometry using labeling device 100. First labeling portion 112 can be used to apply a first label to a first medium having first geometries and second labeling portion 115 can be used to apply a second label to a second medium having second geometries.

For first labeling portion 112, the user positions the first label on holding surface 125 within peripheral wall 122 and positions the first medium on top shoulder 215 of top piston 200. In this embodiment, first labeling portion 112 applies labels to compact discs so the first label will be positioned on holding surface 125 such that second cylindrical member 220 passes through a central aperture of the label, and the first medium will be positioned on top piston 200 such that first cylindrical member 210 passes through a central aperture of the first medium and the first medium rests upon and is flush with top shoulder 215 of the top piston. A user then applies a force upon top piston 200, which causes the top piston to move against the bias of the resilient member through top opening 130 until top shoulder 215 is in proximity to top holding surface 125. As a result, the first medium and the first label move relative to each other until they make contact and the first label is applied to the first medium. The use of movable top piston 200 and peripheral wall 122 ensure that the first label and the first medium are concentrically aligned.

For second labeling portion 115, the user positions the second label on bottom surface 165 within peripheral wall 160 and positions the second medium on bottom shoulder 265 of bottom piston 250. In this embodiment, second labeling portion 115 applies labels to compact discs so the second label will be positioned on bottom surface 165 such that second cylindrical member 270 of bottom piston 250 passes through a central aperture of the label, and the second medium will be positioned on bottom shoulder 265 of the bottom piston such that first cylindrical member 260 passes through a central aperture of the second medium. A user then applies a force upon bottom piston 250, which causes the bottom piston to move against the bias of the resilient member through bottom opening 170 until bottom shoulder 265 is in proximity to bottom holding surface 165. As a result, the second medium and the second label move relative to each other until they make contact and the second label is applied to the second medium. The use of movable bottom piston 250 and peripheral wall 165 ensure that the second label and the second medium are concentrically aligned.

It should be recognized by one of skill in the art that while this embodiment allows for application of labels to a 120 mm CD and an 80 mm CD, alternative sizes and shapes of media can also be accommodated by varying the sizes and shapes of top plate 120, bottom plate 150, top piston 200 and bottom piston 250.

Figure 14:
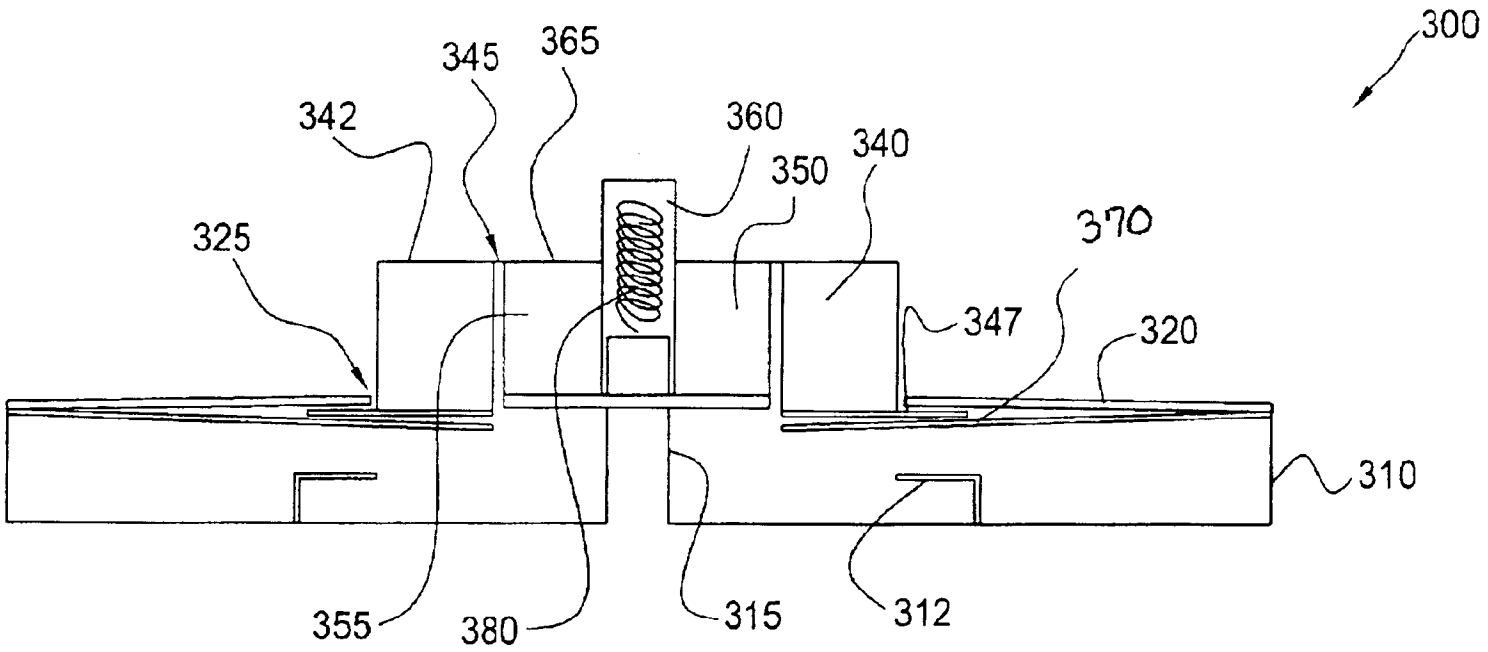
FIG. 14 shows a schematic cross-sectional view of a third embodiment of the labeling device of the present invention.

Referring to FIG. 14, there is shown a third embodiment of a labeling device of the present invention generally represented by reference numeral 300. Labeling device 300 has a housing 310, an outer piston 340, an inner piston 350, an outer resilient member 370 and an inner resilient member 380.

Housing 310 has a disc-like shape with a lock 312, a stem or spigot 315 and an upper surface 320. Upper surface 320 is substantially planar and has an upper opening 325 formed therein. Preferably, upper opening 325 is centrally formed in upper surface 320. Stem 315 has a cylindrical shape and extends from housing 310 through upper opening 325 substantially perpendicular to upper surface 320. Preferably, stem 315 extends above upper surface 320. Lock 312 is disposed along a bottom portion of housing 310 and communicates with a locking arm 347 disposed on outer piston 340, as will be discussed later in detail. Alternatively, lock 312 can be positioned on other portions of housing 310, which allow for communication between the lock and outer piston 340.

Outer piston 340 has a cylindrical shape with a top surface 342, a center opening 345 and a locking arm 347. Outer piston 340 has a diameter that allows the outer piston to slide through upper opening 325 of housing 310. Outer piston 340 has a height that allows top surface 342 to be in proximity to upper surface 320 when the outer piston slides through upper opening 325. Center opening 345 is formed in a center portion of outer piston 340. Locking arm 347 is preferably disposed along a lower portion of outer piston 340 and selectively communicates with lock 312 of housing 310. Alternatively, locking arm 347 can be positioned in other portions of outer piston 340, which allow for communication between the locking arm and lock 312.

Inner piston 350 has a telescoping cylindrical shape and has a lower cylindrical member 355 and an upper cylindrical member 360. Upper cylindrical member 360 has a hollow inner portion with an inner diameter that is larger than the diameter of stem 315 so that inner piston 350 can slide along the stem. Upper cylindrical member 360 has an outer diameter that is smaller than the outer diameter of lower cylindrical member 355 and is concentrically aligned with the lower cylindrical member to form a shoulder 365. Lower cylindrical member 355 has a diameter that allows inner piston 350 to be partially disposed through center opening 345 of outer piston 340. Lower cylindrical member 355 has a height that allows shoulder 365 to be in proximity to upper surface 320 when inner piston 350 slides down along stem 315 through upper opening 325 of housing 310.

Outer resilient member 370 is in communication with outer piston 340 and provides a bias to the outer piston such that the outer piston extends above upper surface 320. Preferably, outer resilient member 370 is a flat or torsion spring that is secured to housing 310. Inner resilient member 380 is in communication with inner piston 350 and provides a bias to the inner piston such that shoulder 365 extends above upper surface 320. Preferably, inner resilient member 380 is a coil spring that is disposed in the hollow inner portion of upper cylindrical member 360. While this embodiment has a torsion spring 370 and a coil spring 380 to provide bias to outer piston 340 and inner piston 350, respectively, alternative resilient members or biasing structures can also be used.

In this embodiment, the positioning and communication between outer piston 340 and inner piston 350, allow a 120 mm CD label and an 80 mm CD label to be accurately located on a 120 mm CD and an 80 mm CD, respectively. While the present invention allows for application of labels to a 120 mm CD and an 80 mm CD, alternative sizes and shapes of media can also be accommodated.

In operation, a user can apply labels to media of different geometry using labeling device 300. A first label can be applied to a first medium having first geometries and a second label can be applied to a second medium having second geometries.

For the first label and medium, the user positions the first label on upper surface 320 and positions the first medium on shoulder 365 of inner piston 350 and top surface 342 of outer piston 340. In this embodiment, the first medium is a compact disc so the first label will be positioned on upper surface 320 such that outer and inner pistons 340, 350 pass through a central aperture of the label, and the first medium will be positioned on the outer and inner pistons such that upper cylindrical member 360 of the inner piston passes through a central aperture of the first medium and the first medium rests upon and is flush with top surface 342 and shoulder 365. A user then applies a force upon outer and inner pistons 340, 350, which causes the outer and inner pistons to move against the bias of resilient members 370, 380 through upper opening 325 until top surface 342 and shoulder 365 are in proximity to upper surface 320 of housing 310. As a result, the first medium and the first label move relative to each other until they make contact and the first label is applied to the first medium. The use of movable outer and inner pistons 340, 350 ensure that the first label and the first medium are concentrically aligned.

For the second label and medium, the user applies a force upon outer piston 340 against the bias of outer resilient member 370 so that the outer piston slides through upper opening 325 and top surface 342 is in proximity to upper surface 320. The user then engages locking arm 347 with lock 312 so that outer piston 340 is retained in the lowered position with top surface 342 in proximity to upper surface 320. Preferably, top surface 342 is flush with upper surface 320. In this embodiment, the selective engagement of lock 312 and locking arm 347 is provided by a rotation or twisting motion of outer piston 340 so that the locking arm is slid under the lock. Alternative structures can also be used to provide for selective engagement of lock 312 and locking arm 347.

The second label is then positioned on upper surface 320 and the second medium is positioned on shoulder 365 of inner piston 350. In this embodiment, the second medium is a compact disc so the second label will be positioned on upper surface 320 such that lower cylindrical member 355 of inner piston 350 passes through a central aperture of the label, and the second medium will be positioned on shoulder 365 of the inner piston such that upper cylindrical member 360 passes through a central aperture of the second medium. A user then applies a force upon inner piston 350, which causes the inner piston to move against the bias of inner resilient member 380 through upper opening 325 until shoulder 365 is in proximity to upper surface 320. As a result, the second medium and the second label move relative to each other until they make contact and the second label is applied to the second medium. The use of movable inner piston 350 having lower cylindrical member 355 and upper cylindrical member 360 ensure that the second label and the second medium are concentrically aligned.

It should be recognized by one of skill in the art that while this embodiment allows for application of labels to compact discs, alternative sizes and shapes of media can also be accommodated by varying the sizes and shapes of outer piston 340 and inner piston 350.

The present invention having thus been described with particular reference to the preferred forms thereof, it will be obvious that various changes and modifications may be made therein without departing from the spirit and scope of the present invention as described in the appended claims.

What is claimed is:

1. A labeling device for applying a first label having a first center hole with a first diameter to a first medium having a first geometry and for applying a second label having a second center hole with a second diameter to a second medium having a second geometry, the device comprising:

a housing having a first labeling portion and a second labeling portion, said first labeling portion having a first locating member, said second labeling portion having a second locating member, wherein said first locating member locates the first center hole of the first label and said first labeling portion applies the first label to the first medium, and wherein said second locating member locates the second center hole of the second label and said second labeling portion applies the second label to the second medium.

2. A labeling device for applying a first label to a first medium and for applying a second label to a second medium, the device comprising:

a first labeling portion having a first surface and a second surface; and a second labeling portion having a third surface and a fourth surface, said first labeling portion being connected to said second labeling portion, wherein said first and second surfaces are movable relative to each other from a first position in which said first and second surfaces are remote from each other to a second position in which said first and second surfaces are in proximity to each other, wherein said third and fourth surfaces are movable relative to each other from a third position in which said third and fourth surfaces are remote from each other to a fourth position in which said third and fourth surfaces are in proximity to each other, and wherein one of said first or second surfaces holds said first label and the other of said first or second surfaces holds said first medium, and one of said third or fourth surfaces holds said second label and the other of said third or fourth surfaces holds said second medium.

3. The device according to claim 2, wherein said first labeling portion further comprises a first piston and a first housing, said first surface being disposed on said first piston and said second surface being disposed on said first housing, and wherein said second labeling portion has a second piston and a second housing, said third surface being disposed on said second piston and said fourth surface being disposed on said second housing.

4. The device according to claim 3, wherein said first housing has a first opening formed therein and said first piston travels partially through said first opening, and wherein said second housing has a second opening formed therein and said second piston travels partially through said second opening.

5. The device of claim 3, further comprising a resilient member that biases said first and second pistons so that said first and second surfaces are in said first position and said third and fourth surfaces are in said third position.

6. The device of claim 5, wherein said first housing has at least one holding tab for locating said first label or said first medium on said second surface.

7. The device according to claim 5, wherein said second housing has a wall on at least a portion of said fourth surface for locating said second label or said second medium on said fourth surface.

8. The device according to claim 7, wherein said wall has a circular portion and a planar portion, said circular portion being for locating said second label or medium having a circular shape and said planar portion being for locating said second label or medium having a rectangular shape.

9. The device according to claim 5, wherein said first housing comprises a stem and said first piston comprises a center opening, and wherein said stem is disposed through said center opening so that said first piston can move along said stem.

10. The device according to claim 5, wherein said first piston comprises a first cylindrical member and a second cylindrical member having an inner hollow portion, and said second piston comprises a third cylindrical member, a fourth cylindrical member and a fifth cylindrical member, wherein said fifth cylindrical member is at least partially disposed in said inner hollow portion of said second cylindrical member, wherein said first and second cylindrical members are concentrically aligned to form a first shoulder, said first surface being disposed on said first shoulder, and wherein said third and fourth cylindrical members are concentrically aligned to form a second shoulder, said third surface being disposed on said second shoulder.

11. The device according to claim 10, wherein said resilient member is disposed in said inner hollow portion of said second cylindrical member.

12. A labeling device for applying labels to media that have different geometries, the device comprising:

a housing having an upper surface and an opening formed through said upper surface;

an outer piston having a top surface and an orifice formed through said top surface;

an inner piston having a shoulder, said inner piston being disposed at least partially in said orifice of said outer piston; and a locking mechanism, wherein said outer piston slides through said opening in said upper surface from a first position in which said top surface is remote from said upper surface to a second position in which said top surface is in proximity to said upper surface, wherein said inner piston slides through said orifice in said outer piston from a third position in which said shoulder is remote from said upper surface to a fourth position in which said shoulder is in proximity to said upper surface, wherein said locking mechanism selectively retains said outer piston in said second position, and wherein said upper surface locates said labels and said shoulder locates said media.

13. The device according to claim 12, wherein said housing comprises a stem and said inner piston comprises a hollow inner volume, and wherein said stem is disposed at least partially in said hollow inner volume so that said inner piston can move along said stem.

14. The device according to claim 12, wherein said inner piston comprises a first cylindrical member and a second cylindrical member, said first and second cylindrical members being concentrically aligned to form said shoulder and said second cylindrical member being at least partially disposed in said orifice in said outer piston.

15. The device according to claim 12, further comprising a first resilient member and a second resilient member, said first resilient member biasing said outer piston in said first position and said second resilient member biasing said inner piston in said third position.

16. The device according to claim 15, wherein said first resilient member is a torsion spring and said second resilient member is a coil spring.

17. The device according to claim 16, wherein said torsion spring is secured to said housing.

18. The device according to claim 17, wherein said torsion spring is first and second torsion springs that are secured on opposing sides of said housing.

19. The device according to claim 12, wherein said outer piston has a retaining member extending outwardly from said outer piston, and wherein said retaining member retains said outer piston in said opening in said upper surface of said housing.

20. The device according to claim 12, wherein said locking mechanism selectively engages with a lower portion of said outer piston.

21. The device according to claim 12, wherein said outer piston has a locking arm, and wherein said locking mechanism selectively engages with said locking arm.

22. The device according to claim 21, wherein said locking arm is disposed on a bottom portion of said outer piston.

23. The device according to claim 22, wherein said locking mechanism is disposed on a lower portion of said housing.

24. The device according to claim 15, wherein said inner piston has an open lower end and a hollow interior, and wherein said second resilient member is at least partially disposed in said hollow interior.

25. The device according to claim 24, wherein said second resilient member is a coil spring.

* * * * *